United States Patent [19]

Hopper

[11] Patent Number: 4,848,472

[45] Date of Patent: Jul. 18, 1989

[54] INSERT CHOKE AND CONTROL MODULE THEREFOR

[75] Inventor: Hans P. Hopper, Aberdeen, Scotland

[73] Assignee: British Petroleum Co., p.l.c., Britannic House, England

[21] Appl. No.: 272,148

[22] Filed: Nov. 16, 1988

[51] Int. Cl.[4] ..... E21B 23/00; E21B 34/04; E21B 34/16

[52] U.S. Cl. ..... 166/344; 166/339

[58] Field of Search ..... 166/338, 339, 340, 341, 166/344, 330

[56] References Cited

U.S. PATENT DOCUMENTS

| | | | |
|---|---|---|---|
| 3,071,188 | 1/1963 | Raulins | 166/340 X |
| 3,163,223 | 12/1964 | Bauer et al. | 166/344 X |
| 3,179,176 | 4/1965 | Goepfent | 166/340 X |
| 3,259,191 | 7/1966 | McClintock et al. | 166/340 X |
| 4,456,070 | 6/1984 | Watkins | 166/344 X |

*Primary Examiner*—Stephen J. Novosad

*Attorney, Agent, or Firm*—David J. Untener; Larry W. Evans

[57] ABSTRACT

An insert choke for a sub-sea oil production module has a body and releasable latch for locking it into a housing of the production module, and a variable choke constriction within the body which can be adjusted by a screw-threaded stem co-operating with a screw threaded member which can be rotated manually, by an ROV, or by an associated choke control module.

The associated module, if used, fits over the insert choke and has releasable latches for locking it to the choke, and gearing and motor(s) for rotating the screw threaded member and adjusting the choke. Hydraulic cylinders and pistons actuate both the releasable latches of the choke within the choke housing and the latches for locking and unlocking the choke to and from the control module.

12 Claims, 7 Drawing Sheets

Figure 1:
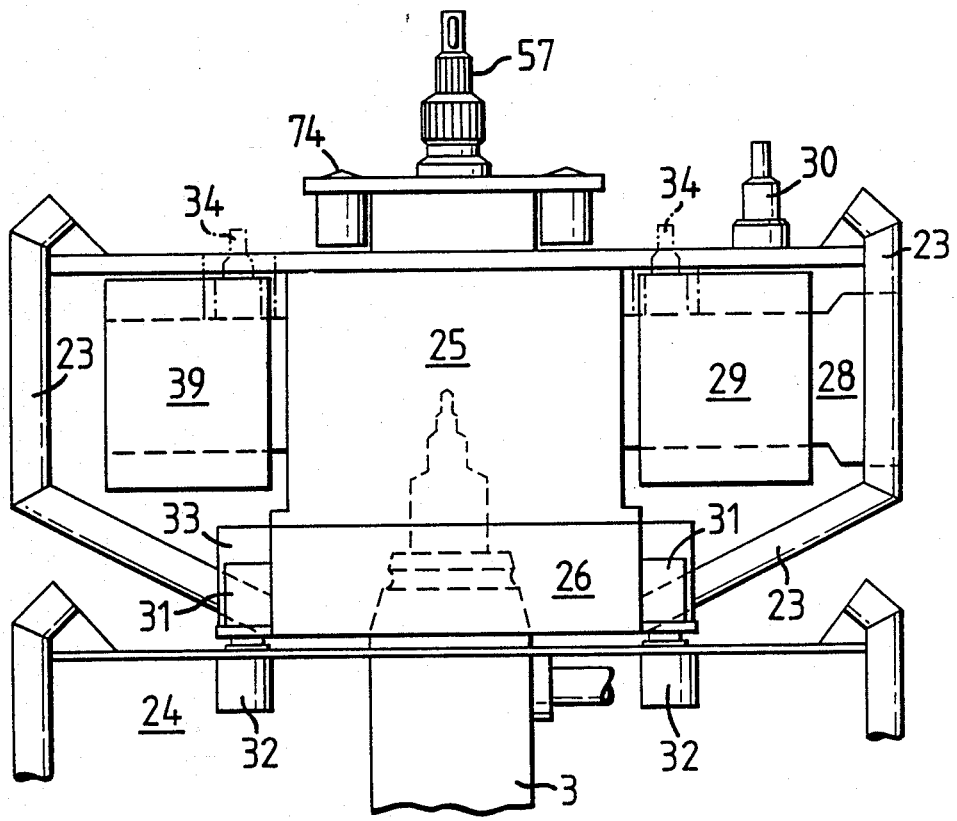

41
53
60
74
36
37
48
49
54
40
56
42
35
51
43
54A
44
46A
46
66
25
62
68
38
18
50
64
65
69
52
105
16
70
63
67
26
13
73
14
72
12
71
27
33
31
11
78
32
6
7
4
3
8A
10
77
9
76
5

INSERT CHOKE AND CONTROL MODULE THEREFOR

This invention relates to an insert choke for a sub-sea oil production block and to a control module therefor.

In many subsea oil production assemblies, well heads and chokes for controlling the crude oil production are situated above water on a fixed platform. Sub-sea production modules are now beginning to be installed and some of the production modules have sub-sea chokes on them. The advent of multi-well sub-sea production systems and the need to flow different wells into a common pipeline has emphasised the need for a choke to regulate each well. Using gate valves to shut off a production flow is a poor practice due to the cutting and washing action. The use of a choke to close off the flow is considered the better practice. Gate valves will still be required in the system for pressure isolation but flow can be prevented by the choke, allowing the gate valves to be opened or closed in a non-flowing system.

Because of these needs, a full stroking choke that can be gradually opened, finely adjusted in either direction and can be fully closed is desirable.

In their earlier form, sub-sea chokes were simply attached to the side or top of a module well block by flanged joints bolted to the tree. Such chokes could only be removed by divers going down to unbolt the flanges.

Later on, insert chokes were developed, such chokes, as their name implies, being inserted into a housing in the body of an oil production module and being held there by clamps or flanged joints. Some of these insert chokes were manual, being controlled and adjusted by divers or by a remotely operated vehicle (ROV). Others were controlled automatically from the module, using instrumentation and hydraulic or electrical controls within the module. If such insert chokes, whether controlled manually or automatically, need to be replaced, the whole oil production system has to be shut down and flushed before the choke is removed as a whole unit. When the new choke is fitted the choke has to be retested and the whole system pressure tested.

The present invention is concerned with an insert choke which can be controlled by its own control module. The choke and control module are separate components which can be run and landed together but which can be retrieved either independently or together. Any malfunction in the control module can, therefore, be dealt with by simple retrieval and replacement of the malfunctioning part in the control module without disturbing the choke or upsetting the integrity of the oil production system.

According to the present invention, an insert choke for a sub-sea oil production module comprises (a) a choke body adapted to be inserted into a housing on the top of a sub-sea oil production module, (b) a releasable latch for locking the choke body into the housing, (c)a variable choke constriction within the choke body having an externally screw threaded stem extending vertically upwards, (d) a rotatable internally screw threaded member cooperating with the screw threaded stem to raise or lower the stem and variable choke constriction on rotation of the member, and (e) means associated with the rotatable member to allow it to be rotated either by an ROV or divers or by an associated choke control module.

The present invention includes a control module for an insert choke as described above comprising (a) a framework adapted to surround the insert choke, (b) a drive motor and gearing adapted to engage the rotatable member of the insert choke, (c) a releasable latching mechanism for holding the insert choke within the control module, and (d) one or more hydraulic cylinders and pistons for actuating the releasable latching mechanism.

Since the present invention provides an insert choke and a control module as separate parts which can, nevertheless, be latched together, it can be used in a number of ways. In the preferred form of operation the control module and insert choke are run, orientated and landed using two-step soft landing jacks onto an oil production module together, assisted by an ROV if required, the insert choke entering into the choke housing in the oil production module and the control module resting on top of the production module. The control module can have a releasable connector cap co-operating with a hub on the production module. As the control module is lowered onto the production module, the soft landing jacks will control its landing and the connector cap can latch onto the hub so that the control module is held firmly on the production module. The control module may then be used to drive the insert choke further into the choke housing, energising metal to metal seals and locking the choke into the housing with preloading.

Once the insert choke is in its housing, it can be released from the control module. This will be the normal operating mode with the insert choke latched into the production module housing and with the control module surrounding it but not latched to it. The drive gearing, being independent of the latching, will be in contact with the rotatable member of the choke, so that the control module can adjust the choke even though it is not latched to it.

If desired, the control module can now be retrieved leaving the insert choke in place and capable of being adjusted manually, if required, by divers or by an ROV. A simplified version of the control module could thus, in effect, be simply a running tool for landing and locking the insert choke into the production module.

Preferably, however, the control module is kept in place so that it can be used to adjust the choke as required by signals transmitted to the drive motor and gearing. If there is any malfunction in the control module (and it is in the control functions that malfunctioning is most likely to occur) then the control module can be retrieved leaving the choke in place and with the oil production system still operational and unaffected.

If, however, the malfunction happens to be in the choke itself, then the choke can be re-latched to the control module and released from its housing so that the control module and choke can be retrieved together, in the same way as they are run and landed together.

The insert choke of the present invention can be used to control the flow of any fluid in a sub-sea oil production system and the term "a sub-sea oil production module" is not to be taken to imply that the choke is only to be used in controlling crude oil flow. It could be used equally for the control of gas flow, either from a gas well or gas separated sub-sea from its associated crude. It could also be used to control the flow of artificial lift fluid into a well or other fluids (e.g. injection water or injection chemicals) required in a sub-sea system.

The control module of the present invention can also house additional control functions to those required for operating the insert choke. It can be used for transmitting hydraulic and/or electrical controls to the oil production module itself. These additional and quite separate aspects of the control module do not form part of the present invention and have been described and claimed in the specification of UK Patent Application No. 2194980A.

Figure 2:
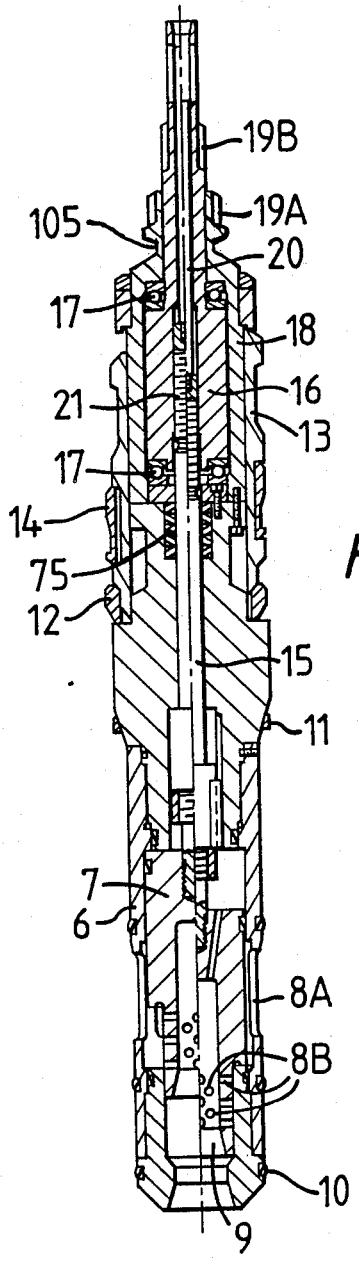
Figure 3:
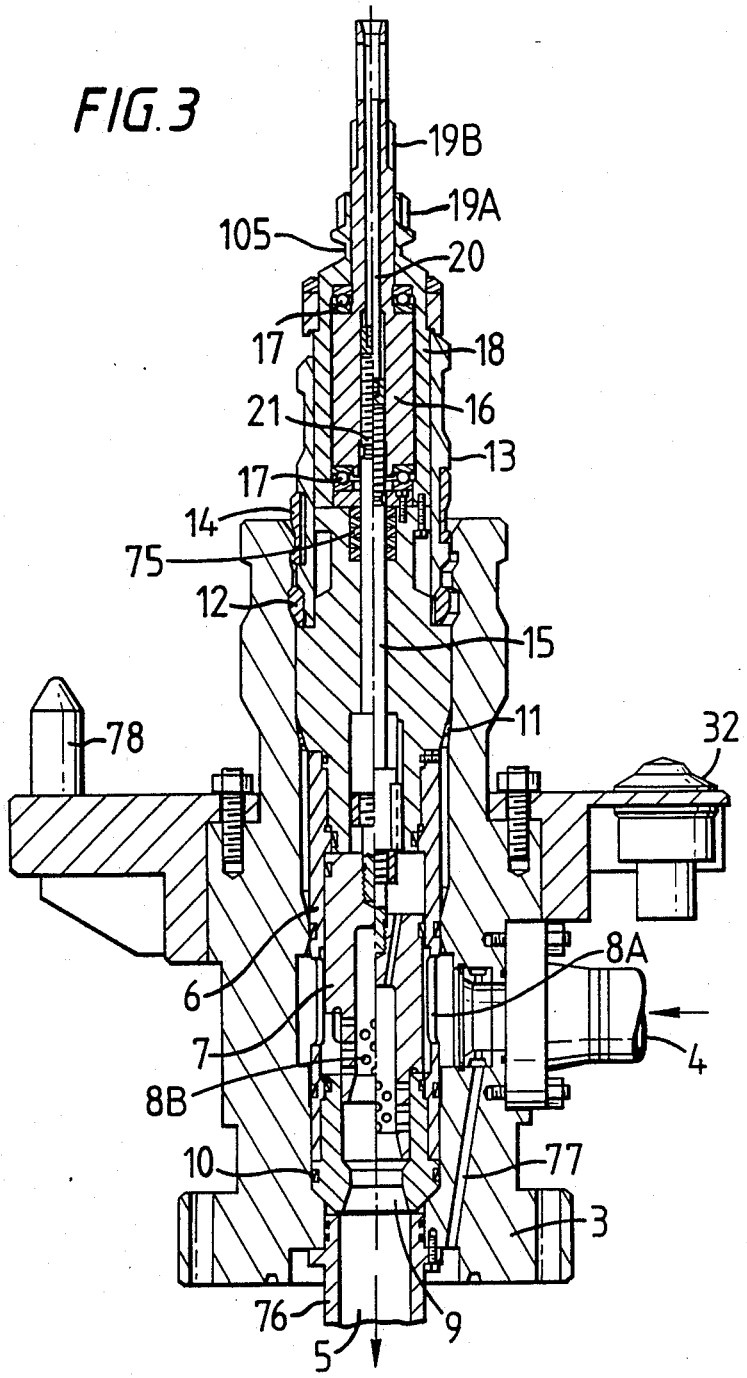
Figure 4:
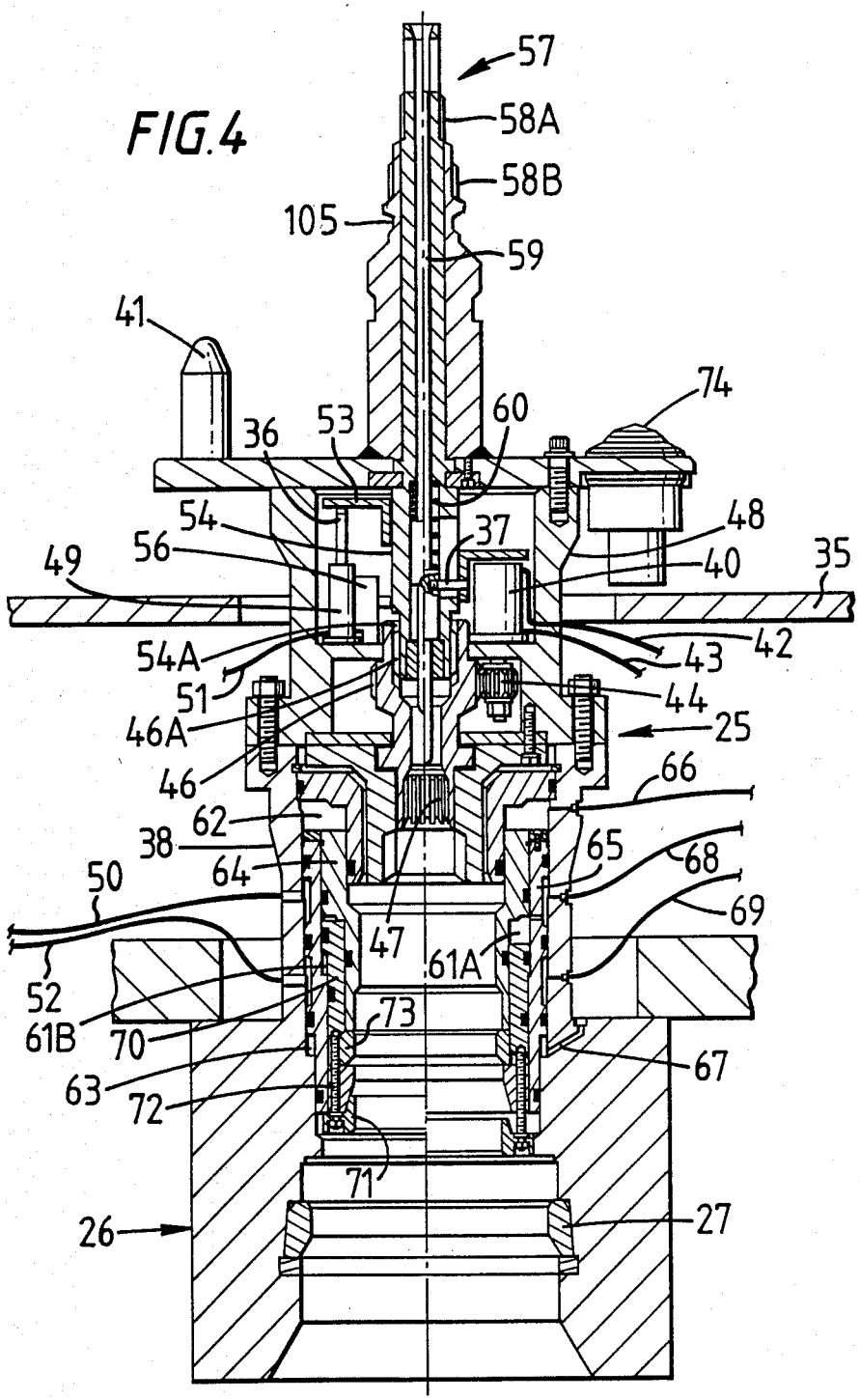
Figure 5:
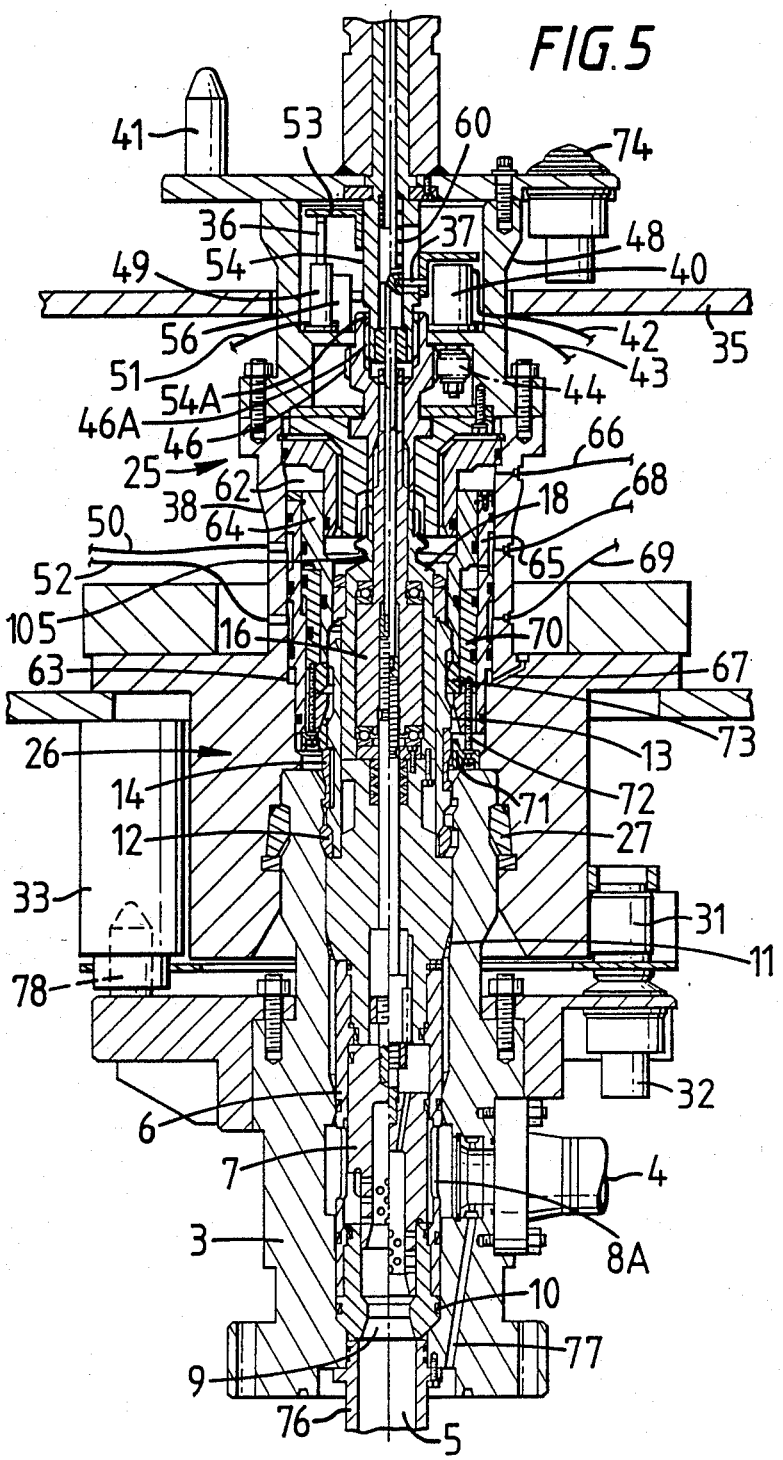
Figure 6:
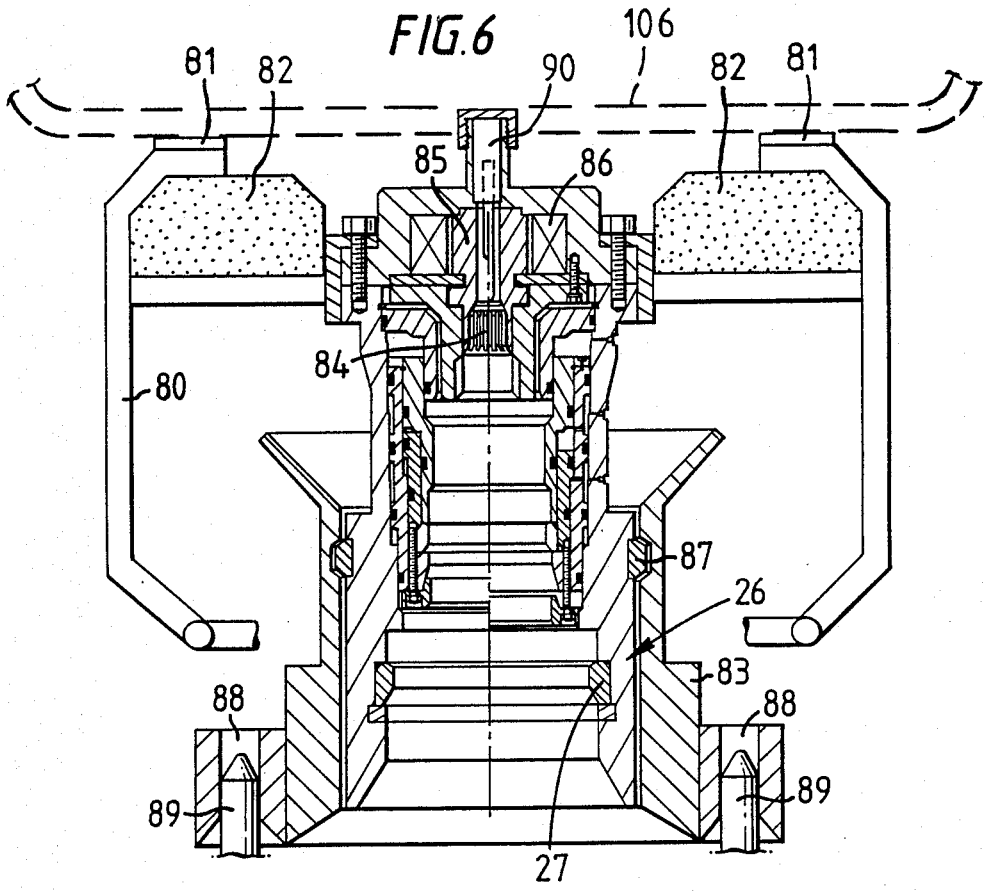
Figure 7:
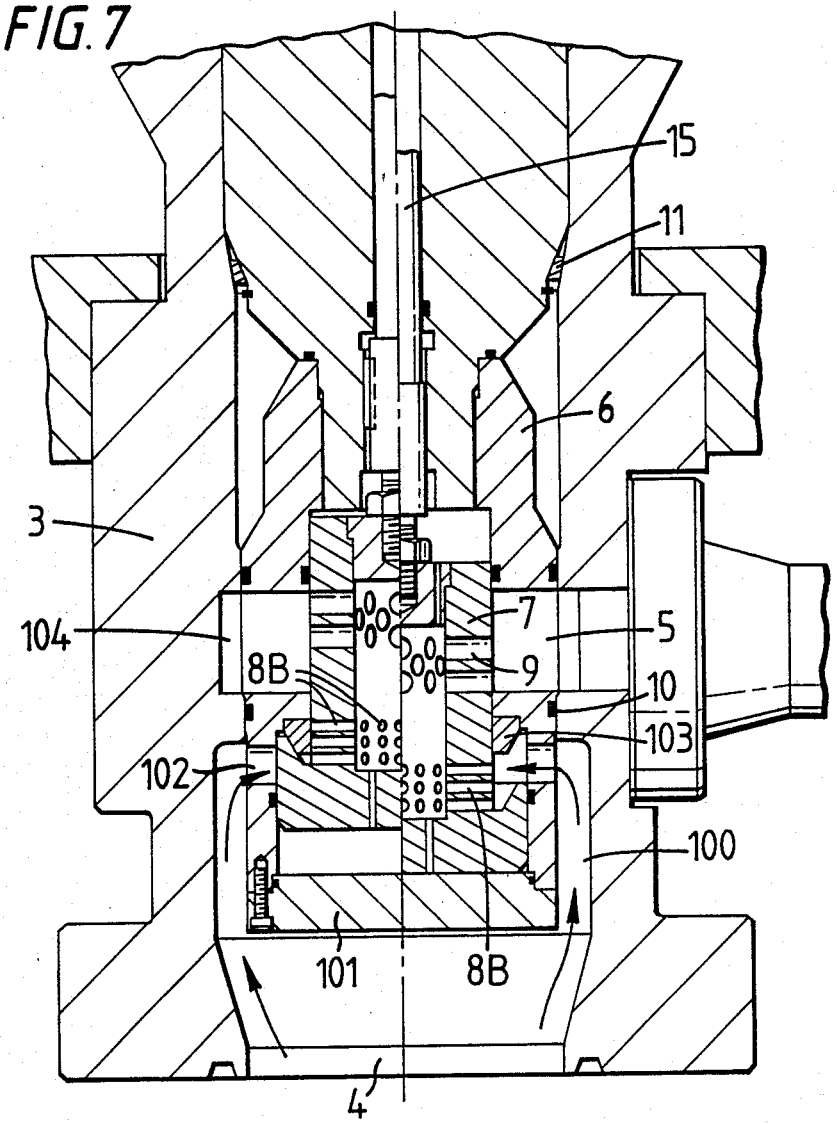

The invention is further illustrated and described with reference to the accompanying drawings in which, FIG. 1 is a view of a choke control module for use in the present invention, FIG. 2 is a section through an insert choke of the present invention, FIG. 3 shows the insert choke of FIG. 2 in position within a choke housing, FIG. 4 is a section through the choke control mechanism of the choke control module of FIG. 1, FIG. 5 shows the assembled choke body and housing of FIG. 3 with the choke control module of FIG. 4, FIG. 6 is a section through an ROV operated change out tool for a manual insert choke of the present invention, and FIG. 7 is a section through an alternative design of insert choke.

FIG. 1 gives a general view of a control module which has a choke control mechanism for operating an insert choke according to the present invention.

In FIG. 1 the control module has a main framework formed of an external guide frame 23 which can be used in a guidelineless mode to guide the module into a template or other framework (not shown) and align it with an oil production module 24. As an alternative to the frame, a normal system of guidelines, guide posts and guide tubes could be used. Within the external guide frame 23 is an internal framework for a choke control mechanism which is indicated generally at 25 and which is described in detail with reference to FIG. 4.

At the bottom of the module are self-aligning 2-step soft landing jacks 33 so that the control module can be aligned with and lowered gently onto top of production module 24. The control module also has a connector cap 26 at its base having a releasable latch ring (27 of FIG. 4) which cooperates with a recess in a hub (indicated by dotted lines) at the top of choke housing 3. The cap with its ring is normally locked and unlockeck hydraulically. In the event of hydraulic failure there are rods and spigots 34 to unlock the connector cap and ring mechanically. Dogs or collets could be used instead of a ring.

Also shown in FIG. 1, but not forming part of the choke control mechanism of the present invention, is equipment for transmitting hydraulic and electrical controls via the control module into production module 24 described in detail and claimed in the specification of UK Patent Application No. 2194980A. This equipment consists of a horizontal junction plate receptacle 28 capable of receiving hydraulic and electrical coupler stabs from a control tray (not shown) and a junction plate piston 29 which is operated hydraulically but which has a rod and spigot 30 so that it can be retracted mechanically if required. The hydraulic and electrical lines of junction plate receptacle 29 lead to a control unit 39. This control unit 39 controls both the choke and the production module 24, there being lines (not shown) to the choke controls and also to hydraulic/electrical coupler stabs 31 which co-operate with hydraulic/electrical coupler receptacles 32 on production module 24. The hydraulic/electric control unit 39 has one or more hydraulic accumulators and appropriate valves and controls to feed hydraulic fluid to the actuating parts of the choke and to the production module via couplers 31 and 32.

At the top of the module framework are hyraulic-/electrical couplers 74, which couple with a running tool used to run and land the control module and allow the tool to operate, hydraulically, the connector cap 26, the soft landing jacks 33, and, if desired, the junction plate piston 29.

Also shown in FIG. 1 is mechanical override 57 for the insert choke. This forms part of the control mechanism of the module and is described in detail with reference to FIG. 4.

Within the area 25 of FIG. 1 is the insert choke and choke control mechanism shown in FIGS. 2, 3, 4 and 5.

FIG. 2 shows the insert choke, the left hand side of the centre line showing it in its fully open position and the right hand side in its closed position.

As previously explained, in FIG. 1, the top of a sub-sea oil production module has a choke housing 3 in it, with an inlet 4 and outlet 5 (see FIG. 3). The functions of these could be reversed, 4 being the outlet and 5 the inlet. Fitting closely within the housing 3 is an insert choke shown in FIG. 2 and formed of a choke body 6 and a choke cage 7 within it. This part of the choke is designed according to conventional practice. Choke body 6 has ports 8A which line up with choke housing inlet 4. Choke cage 7 is hollow with a number of holes 8B in it and has an outlet 9 which lines up with choke housing outlet 5 (FIG. 3). It will be seen that raising or lowering cage 7 within the body 6 alters the number of holes 8B which are aligned with ports 8A and hence the number of holes which are open and exposed to the flow of fluid through the housing and body. Although a choke cage is shown in FIG. 2, other forms of variable chokes could be used, e.g. a tapering plug fitting in an orifice, or two plates with holes through them, one plate being fixed and the other being rotatable to align or non-align the holes.

Choke body 6 is maintained fluid tight within housing 3 by elastomeric seal 10 and metal seal 11 pushing against shoulders of the housing.

Choke body 6 extends upwardly above the housing 3. It is held into the housing by a lock ring 12, pushed into a recess in the housing by a cylinder 13. Cylinder 13 has a secondary spring latch 14 which fits into a second recess in the housing. Cylinder 13 can be actuated by the control module so as to lock ring 12 into the housing as described hereafter. Cylinder 13 is itself latched down by spring latch 14 thereby giving a double lock down of the choke body in the housing.

Stem 15 extends up from cage 7 within body 6. Its top is screw threaded at 21 and is threaded into a rotatable member 16 which has a corresponding internal screw thread. Bearings 17 allow member 16 to rotate relative to the body 6. Packing 75 around member 16 below lower bearings 17 acts to make the assembly fluid-tight. Above rotating member 6 is a non-rotating cap 18 screwed to choke body 6 and having external splines 19A. Within member 16 and cap 18 is an indicator rod 20 secured to the top of stem 15. The indicator rod 20 gives an indication of the position of cage 7 within body 6 (and hence the extent to which the choke is open).

The top of rotating member 16 extends up through non-rotating cap 18 and beyond the cap and this topmost portion of member 16 has external splines 19B. The splines 19A on cap 18 and 19B on member 16 give in combination, a reaction spline and torque spigot through which the choke is adjusted by a control module, an ROV or a manually-operated tool.

A groove 105 is also shown below splines 19A. This is to allow the insert choke to be held by the latches of a running tool or other manipulating device.

FIG. 3 shows the insert choke of FIG. 2 positioned within the choke housing of FIG. 1. The left hand side of the centre line shows the choke fully open and locked into the housing by cylinder 13 bearing against lock ring 12 and with secondary spring latch 14 also latched into a recess at the top of housing 3.

The right hand side of the centre line is a section at 90° to the left hand side and shows the choke in its closed position and unlocked from the housing. (The locking and unlocking mechanism is described in FIGS. 4 and 5).

FIG. 3 also gives additional detail of housing 3 over and above that of FIG. 1. Thus inlet 4 and outlet 5 are shown lining up with choke ports 8A and outlet 9. Also shown is a wear sleeve 76 around outlet 5. Outside of this wear sleeve is an annular void separate from the main oil production outlet into which chemical fluid can be injected to travel via a port 77 drilled into the housing into the inlet 4 of the housing and hence into the production oil.

Hydraulic-electrical couplers 32 are shown on the right hand side, and an orientation pin 78 for soft landing jack 33 of FIG. 1. Since the two sides of FIG. 3 are at 90° to each other it will be appreciated that there are two sets of couplers and two orientation pins in planes at right angles to each other on the housing 3. More than two sets of couplers could be used, if required.

FIG. 4 shows the choke control mechanism which is within the area 25 of the control module of FIG. 1.

As with FIG. 3, the left and right hand sides of FIG. 4 are at 90° to each other. The left hand side shows the latching mechanism just unlatched with the energising piston at mid-stroke; the right hand side shows the latches fully locked, again with the energising piston at mid-stroke. The mechanism which is indicated generally at 25, fits within framework member 35 of the control module.

The choke actuation mechanism has two hydraulic drive motors supported on a framework 48. Only one motor 40 is shown, the other being at 180° to it on the other side of the framework. Hydraulic lines 42,43 are supply and return lines for hydraulic fluid from the control unit (39 of FIG. 1). Motor 40 rotates a driving cog 44 and the other motor rotates another driving cog on the other side of the frame. Cog 44 and the other cog mesh with central gear wheel 46. Wheel 46 has a downwardly extending sleeve 47 with splines at its end which cooperate with splines 19B on choke member 16 (FIG. 2). Operation of the motors and cogs thus rotates gear wheel 46, and, through the splines 19B, the rotating member 16 of the choke. Depending on the rotation of the member 16 either clockwise or anti-clockwise, the choke cage 7 is either raised or lowered. Although hydraulic motors are described, it will be appreciated that electric motors could be used with appropriate electrical cables instead of the hydraulic lines 42, 43.

Top framework member 35 encompasses the framework 48 above gear wheel 46. This does not rotate but supports the motors, two choke travel measurement sensors, and a mechanical override for manually rotating gear wheel 46 in the event of hydraulic failure.

One of the choke travel measurement sensors is shown at 49 on the left hand side of the figure. The other is on the other side of the framework at 180° to it. The mechanical override is shown at 57 above framework 48 and will be further described hereafter.

The drive motors may be of any convenient type but should be of a type that engages the cog in one direction and can free-wheel in the other, i.e. they are of a type which can be rotated mechanically and which are not damaged by such rotation. This allows the mechanical override to be used, if required.

The choke travel measurement sensors can be two linear voltage differential transformers with electrical lines from them leading to control unit 39. Line 51 is shown connecting to sensor 49. Piston 36 at the top of sensor 49 bears against an indicator plate 53. This plate can move vertically up and down, being held onto indicator rod 59 by pin 37. The inside of plate 53 fits over sleeve 54 which fits within gear wheel 46. Sleeve 54 is splined at 54A which engages with splines 46A on an upper extension of gear wheel 46. Sleeve 54 extends upwardly to become stem 58A of the mechanical override 57. Indicator pin 59 rests on indicator pin 20 of the choke body (see FIG. 2). Movement of indicator pin 20 thus moves indicator pin 59, which in turn through pin 37 moves indicator plate 53. This movement is sensed by pin 36 of the choke travel measurement sensor 49 which sends signals to the control unit 39 through line 51.

A further measure of choke movement can be obtained from revolution counter 56 fixed to framework 48. This is also a linear voltage differential transformer with a piston which senses the rotation of gear wheel 46 by monitoring a special set of notches on sleeve 54. Rev counter 56 counts the number of turns and transmits the information back to the control unit. Rev counter 56 can also be used to zero the drive or to recalibrate the sensors.

Manual actuation of the choke can be effected by a mechanical override spigot 57. This is similar to the manual actuator unit at the top of the choke proper, having a splined cap 58A and indicator rod 59 bearing on pin 20 of the choke. Spring 60 holds indicator rod 59 in contact with rod 20. There is a reaction spline 58B on the housing holding cap 58A. Manual rotation of splined cap 58A rotates sleeve extension 54 below it, this sleeve extension fitting as previously indicated into splines of gear wheel 46. Rotation of cap 58A thus rotates gear wheel 46.

The operation of the control module to lock and unlock the insert choke to the choke module and to lock and unlock the insert choke to the choke housing is effected hydraulically by two annular cylinders 62 and 63.

The outside of cylinder 62 is formed by a downward extension 38 of frame 48. The inside is formed of a moveable sleeve 64 having a second sleeve 65 which forms, in effect a two-sided piston. Hydraulic lines 66,67 run to cylinders 62 and 63 so that sleeve 64 can be moved up or down. There are seals at appropriate places to seal moving sleeve 64 against fixed frame 38.

There are further cylinders 61A and 61B within moveable sleeve 64 and 65, there being hydraulic lines 68,69 leading to top and bottom of it with appropriate porting to allow fluid to pass through the moveable sleeve 65. Inside sleeve 65 contained by sleeve 64 is a separate annular piston 70. This two-ended annular piston 70 is connected to rod 72 depending from it and passing between sleeves 64 and 65. Rod 72 is connected to a kick ring 71.

Also shown in FIG. 4 on the top of framework 48 are hydraulic/electrical couplers 74 (also shown and and described in FIG. 1) and an orientation pin 41 for a soft landing jack. As with FIG. 3, it will be appreciated that there are two sets of couplers 74 and two orientation pins 41 in planes at right angles to each other. More sets could be used, if required. Lines 50, 52 are signal lines running from electrical sensors to the control unit to sense the position of sleeve 65 and hence whether it is in the latched or unlatched position.

Finally, FIG. 4 shows how the choke control mechanism fits with connector cap 26 of the control module, this cap having a releasable latch ring 27 for locking the module to the corresponding hub of the choke housing.

The left hand side of FIG. 4 shows the position of the latching mechanism when the insert choke (not shown) is locked to the choke housing but unlocked from the choke control mechanism, this being the normal operational position. The right hand side of FIG. 4 shows the position of the latching for running and landing the control module and the insert choke together (i.e. with the control module and the insert choke locked together).

FIG. 5 shows the control mechanism of FIG. 4 in position over the choke body and choke housing of FIG. 3 and the operations of running and landing, locking and unlocking and retrieving the various parts of the control module and insert choke can best be understood by considering FIG. 5 taken in combination with FIGS. 3 and 4.

As with previous Figures, the left and right hand sides of FIG. 5 are at 90° to each other. The positions of the latching mechanism of the control module are the same as in FIG. 4 and the positions of the choke cage and choke body are the same as in FIG. 3.

To run and land the control module and choke together, the latching mechanism is at the position shown on the right hand side of FIG. 5. Sleeves 64, 65 are moved to their top position, this being effected by supplying hydraulic pressure through line 67. Inner piston 70 can be moved to its bottom position, this being effected by supplying hydraulic pressure through line 68. With the sleeve and pistons in this position, latch 13 of the choke itself is also at its topmost position, its top being hard up against the shoulder of cap 18. Latch 13, which is in the form of a cylinder, drives secondary choke latch 14 which is loaded to splay slightly outwardly.

Since inner piston 70 is at its bottom position, as is rod 72, (connected to kick ring 71) the control module is locked to the choke by piston 70 compressing ring 73 and forcing it into an outer recess at the top of latch 13. This is not a precise lock but a floating one to allow sufficient travel to allow rod 72 to energise ring 73.

The control module and choke locked to it are run and landed, assisted by an ROV if required, the final stages of the landing being controlled by the two-step self-aligning soft landing jacks 33. The choke will then be within housing 3.

The control module is locked to the hub of the choke housing by cap 26 and ring 27. Then the choke is locked into choke housing 3 and unlocked from the control module by the following procedure.

Piston 70 is first moved upwardly by hydraulic pressure through line 69. This frees ring 73 from its locking position in the outer recess of latch 13. Hydraulic pressure on piston 70 is now released by lines 68, 69 being placed to vent. Sleeve 64, 65 are energised by hydraulic fluid introduced through line 66 driving the choke down and driving locking ring 12 into its locking recess. This forcing action also puts downward pressure on the choke itself to plastically deform metal seal 11 into contact with the choke housing 3. Secondary latch 14 also locks into another recess above the recess for ring 12. Electrical position measurement sensors can send signals through lines 50, 52 to confirm the movement of sleeves 64, 65. Sleeves 64, 65, having done their task, can now be moved up again by hydraulic pressure through line 67. This will lift kick ring 71 well clear of secondary latch 14.

The choke is now locked to the choke housing but unlocked from the control module as shown on the left hand side of FIG. 5. This is the point at which the production system would be pressure tested. However, gear wheel 46 is in position to rotate member 16 and move choke cage 7 if required. It is preferred to leave the control module in place but it will be seen that the control module could be removed without affecting the choke simply by unlocking cap 26 and ring 27 from the choke housing hub. If piston 70 has failed or not been operated the preloading of the insert choke on landing by driving 64, 65 down would mean that the bottom of rod 72 and kick ring 71 would bear on the top of choke housing 3 forcing piston 70 to its upward position independent of any hydraulic pressure and ensuring that ring 73 is kept unlocked from latch 13 and hence the control module is kept unlocked from the choke. This is a safety feature to prevent accidental locking and a secondary means of ensuring an unlock of the control module from the choke. The normal mode would, however, be with sleeves 64 and 65 at the top of their stroke with piston 70 at the top of its stroke.

If desired, the choke could be locked back into the control module and unlocked from the housing, thereby enabling both control module and choke to be removed together. This requires positive action by reversing the locking sequence during landing. For this operation sleeves 64 and 65 are driven down by pressure through line 66 and then placed on vent. Piston 70 and rod 72 are now forced down by hydraulic pressure through line 68. Since, however, rod 72 and kick ring 71 bear on choke housing 3, this has the effect of forcing sleeves 64, 65 up. Ring 73 would, at the same time, move into outer recess of latch 13 so locking the choke to the control module. To unlock the choke, sleeves 64 and 65 are raised by pressure through line 67, thereby freeing ring 12 from its lock with the housing. Hydraulic pressure through line 67 will now unseat the insert choke. Use of the soft landing jacks as ejection jacks will further withdraw the insert choke and uncouple the hydraulic/electrical couplers prior to lift off.

There is no mechanical override for this locking and unlocking. However, as the module is kept unlocked from the choke (this can be double checked by the use of position sensors), any failure of the hydraulics of the module can be dealt with by retrieving the module (there is a mechanical unlock 34 for unlocking the control module from the production module) and repairing the hydraulics.

The above description of the interaction between the insert choke and control module will apply irrespective of the precise type of external control module framework and type of oil production module on which it sits. It will be appreciated that the control module framework could be adapted to suit any particular design of production module.

While the present invention is applicable primarily to and has been described particularly with reference to a choke, it will also be appreciated that the invention could be applied to any other internal housing plug. The term "choke" is to be understood in this wide connotation.

The particular framework described is designed to suit a particular oil production module and sub-sea complex described and claimed in the specification of GB Patent Application No. 2174442A. This patent application describes and claims a sub-sea oil production system having a three-dimensional template, the framework of which encloses production bays. Within each production bay is a well block and a manifold block, and the manifold block may have an insert choke in its top. The control module as described in this specification with its particular external framework is designed to fit within the template and form part of the sub-sea production system of GB Pat. No. 2174442A.

The specification of GB Patent Application Nos. 2194980A describes a control system for sub-sea oil production particularly designed to be used in the production system of GB Pat. No. 2174442A. The system comprises a control tray to which hydraulic and electrical power is supplied directly or indirectly via an umbilical and one or more control pods interposed between the control tray and the blocks of an oil production system, these control pods transmitting, through retractable ports, the hydraulic and electrical power from the control tray into the blocks.

As shown in FIG. 1 the control module of the present invention has a junction plate 28 and hydraulic/electrical couplers 32. It can function, therefore, as a form of control pod according to GB Pat. No. 2194980A transmitting hydraulic and electrical power from a control tray into a block. This aspect of the control module is quite independent of the choke control aspects of the module and could be used on its own, even without a choke control system as has been described and claimed in the above-mentioned patent application.

The insert choke and control module of the present invention also has particularly utility for use in a sub-sea process complex as described and claimed in UK Patent Application No. 8807101.

As previously explained, the insert choke of the present invention is particularly suitable for use with the control module as hereinbefore described and particularly suitable for use in the sea-bed oil production complexes of the above-mentioned patent applications. However, also as previously explained, it can be used in any sub-sea system, and can be used in association with a simplified module for landing or retrieving the choke or for adjusting the choke. Such a simplified module is shown in FIG. 6.

In FIG. 6, the module has a light weight guide frame 80 and fixing points 81 for attachment to the underneath of an ROV. Part of the ROV frame is shown at 106. Foam buoyancy 82 is placed at the top of the frame and there is a heavier counter-weight portion 83 of the module at the base, whose purpose will be described hereafter.

Guide frame 80 supports a central choke control mechanism for latching onto or unlatching from a choke and for adjusting a choke. It will be seen that the latching mechanism is similar with that of the control module of FIGS. 4 and 5 and can thus operate in the same way as previously described. It will also be seen that there is a splined internal profile 84 identical with that of FIGS. 4 and 5 which can fit over splines of a spigot at the top of a choke and rotate the choke.

The differences are that the latching mechanism and its cylinders are supplied with hydraulic fluid by lines (not shown) running from the ROV to which the module is attached. The rotation splined internal profile differs in that its housing is driven by torque motor 86. This motor is a hydraulically driven motor, the power being supplied directly from the ROV. Above the housing is a travel measurement sensor 90 to indicate the position of the choke.

The module has a connector cap 26 and lock ring 27 as for the control module of FIGS. 1, 4 and 5 so that it can be locked onto or unlocked from a corresponding hub of a choke housing. This cap supports the counter-weight 83 by means of hydraulically operated lifting ring 87 or equivalent dogs. The counter-weight 83 also has guide cylinders 88 adapted to fit over guide pins 89 similar to the soft landing jack guide pins 78 of the choke of FIG. 3.

Counter-weight 83 is chosen to have a weight equivalent to the weight of the insert choke to be serviced. The amount of buoyancy is chosen so that the module has a slight negative buoyancy when weighted with either the counter-weight 83 or the insert choke itself.

In operation the control module and counter-weight are slung from an ROV and are landed onto an insert choke to be serviced by aligning cylinders 88 over guide pins 89.

If, however, the insert choke is to be recovered, the choke must first be locked to the module. Then the counter-weight can be released from the connector cap by releasing lifting dog 87. This can be done in any convenient manner (e.g. by hydraulic pressure from the ROV) in the same way as any other releasable underwater locking mechanism. The insert choke can then be unlocked from its housing in the same way as that described in FIG. 5 and the ROV can then lift off and recover the module and choke, with the counter-weight remaining in position. When the recovered choke has been repaired or substituted by a new or refurbished choke, it can be replaced in position and locked into its housing. After testing the production interface the choke can be set, torque motor 86 is actuated and, when the adjustment has been made, the control module and counter-weight are then simply lifted off again by the ROV.

By this arrangement, no additional weight is imposed on the ROV when it is required to lift and recover an insert choke, so that a conventional work class ROV could be used to recover an insert choke which would otherwise be too heavy.

The module as shown in FIG. 6 is suitable for use only with a manual choke of the type shown in FIG. 3. For simple adjustment of this choke a manipulator deployable torque tool of the type described in our co-pending British patent application No. 8712055 can be used. It could be adapted for use with an automatic choke by giving it hydraulic/electrical couplers similar to 31 of FIG. 1 which would co-operate with couplers similar to 32 of FIG. 1 so that it receives its signals and instructions from the module on which it is placed.

In FIG. 1, the control module input signals for power have been described as being transmitted through the junction plate 28. If only a choke control module is required, hydraulic and/or electrical controls can be supplied through couplers similar to 31 which would cooperate with couplers similar to 32 so that it receives its signals and instructions from the module on which it is placed.

In FIG. 3 a choke body and choke housing are shown with a radial side inlet at the top and an axial outlet at the base. The specific description states that the functions could be reversed. FIG. 7 shows a design with reversed functions, i.e. a choke with an inlet at the base and a side outlet at the top. The left hand side of FIG. 7 shows the choke closed and the right hand side shows it fully open.

The standard design of choke is that shown in FIG. 3, but for insert chokes positioned on the top of sub-sea oil production modules a downward flow through the choke may not be the most convenient and may require an adapted and more complicated pipework to fit the downward flow. However, the choke of FIG. 3 would not function effectively if the flow were simply reversed. FIG. 7, therefore, shows a modified choke specifically designed for upflow.

In FIG. 7, the basic units of the choke are the same as in FIG. 3. Choke housing 3 has within it, a choke body 6 and choke cage 7 with stem 15 extending up from it. Elastomeric seals 10 and metal seal 11 seal the choke body 6 within the housing 3.

The flow through the choke is shown by the arrows and is up through inlet 4 at the base and out radially through outlet 5 near the top. Inlet 4 differs from outlet 5 of FIG. 3 in that it is enlarged to give an annular area 100 around the base of the choke cage so that the flow into the choke cage is in fact radial through inlet ports 8B. In addition there is a fixed housing 101 surrounding the base of choke cage 7, between it and the annular area 100, with its own radial inlets 102. As will be seen by comparing the two sides of the drawing, upward movement of the choke cage 7 within housing 101 acts to block inlets 102 and inlet ports 8B. This gives the main flow control through the choke. Ring seal 103 seals the base of choke cage 7 within housing 101 and prevents leakage upwardly towards the outlet of the choke.

Figure 7A:
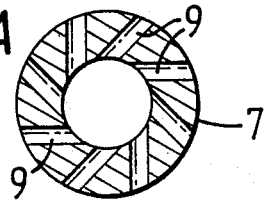

At the top of the choke cage are outlet holes 9 leading into an enlarged annular area 104 around the choke cage 7. Annular area 104 leads into outlet 5. Annular area 104 is of such size that outlet holes 9 are always open and so flow control is exercised solely by the inlets 102 and inlet ports 8B. Outlet holes 9 are tangentially angled through the wall of choke cage 7 (see drawing details, FIG. 7A).

The particular design of FIG. 7 deals with the problem of flow energy which could arise in an upflow choke. Annular area 100 allows the initially axial upward flow to enter the choke cage 7 laterally through points 8B. The flow passing through these points (which are around the whole circumference of choke cage 7) impinges on the flow entering through the opposite ports resulting in the dissipation of the flow energy.

The resulting flow is then vented through large (the drawing shows them as of longer diameter than inlet ports 8B) tangentially angled holes 9 into annular area 104. This creates a circulatory action and reduces the direct upward force on choke body 6.

Taking FIGS. 3 and 7 together it will be seen that the direction of flow through an insert choke on a sub-sea oil production module could be reversed simply by substituting one design of choke for another, without the need for any change in the pipework of flow pattern through other parts of the module. Give the ability inherent in the present invention to retrieve and replace chokes using the choke control module, a simple method of flow reversal is thus available. There are a number of situations where such flow reversal would be desirable or useful, e.g. changing a well from oil production to a water injection well or reinjecting oil or gas into a well previously used for oil production.

I claim:

1. An insert choke for a sub-sea oil production module comprising
   (a) a choke body adapted to be inserted into a housing on the top of a sub-sea oil production module,
   (b) a releasable latch for locking the choke body into the housing,
   (c) a variable choke constriction within the choke body having an externally screw threaded stem extending vertically upwards,
   (d) a rotatable internally screw threaded member cooperating with the screw threaded stem to raise or lower the stem and variable choke constriction on rotation of the member, and
   (e) means associated with the rotatable member to allow it to be rotated either by an ROV or divers or by an associated choke control module.

2. An insert choke as claimed in claim 1 wherein the releasable latch for locking the choke body into the housing has an additional secondary latch.

3. An insert choke as claimed in claim 1 wherein there is a plastically deformable metal/metal seal between the choke body and the housing.

4. An insert choke as claimed in claim 1 wherein the means for rotating the rotatable member includes an indicator rod for indicating the position of the variable choke constriction.

5. An insert choke as claimed in claim 1 wherein the variable choke constriction is a choke cage.

6. An insert choke as claimed in claim 1 having means for injecting chemical fluid into the choke inlet.

7. A control module for an insert choke as claimed in claim 1 comprising
   (a) a framework adapted to surround the insert choke,
   (b) a drive motor and gearing adapted to engage the rotatable member of the insert choke,
   (c) a releasable latching mechanism for holding the insert choke within the control module, and
   (d) one or more hydraulic cylinders and pistons for actuating the releasable latching mechanism.

8. A control module as claimed in claim 7 having a manually operable override for the gearing.

9. A control module as claimed in claim 7 wherein the releasable latching mechanism comprises two cylinders and pistons adapted to lock and unlock the insert choke both to and from the control module and to and from the choke housing.

10. A control module as claimed in claim 7 wherein the control module has a connector cap for releasably locking it to the choke housing.

11. A control module as claimed in claim 7 wherein the module is actuated by a control unit receiving instructions via couplers from the sub-sea oil production module.

12. A control module as claimed in claim 7 wherein the control module is adapted to be suspended from and actuated by an ROV.

* * * * *